US005330590A

United States Patent [19]

Raj

[11] Patent Number: 5,330,590

[45] Date of Patent: Jul. 19, 1994

[54] HIGH TEMPERATURE CREEP AND OXIDATION RESISTANT CHROMIUM SILICIDE MATRIX ALLOY CONTAINING MOLYBDENUM

[75] Inventor: Sai V. Raj, Strongsville, Ohio

[73] Assignee: The United States of America, as represented by the Administrator of the National Aeronautics & Space Administration, Washington, D.C.

[21] Appl. No.: 67,184

[22] Filed: May 26, 1993

[51] Int. Cl.[5] ..... C22C 29/18

[52] U.S. Cl. ..... 148/423; 148/442; 420/428; 420/429; 420/578; 420/588; 75/230; 75/245

[58] Field of Search ..... 148/407, 419, 423, 442, 148/403; 420/428, 429, 578, 588, 442, 584.1; 75/230, 245; C22P 29/18, 27/06

[56] References Cited

U.S. PATENT DOCUMENTS

| | | | |
|---|---|---|---|
| 1,774,849 | 9/1930 | Schröter | 420/429 |
| 4,696,703 | 9/1987 | Henderson et al. | 148/403 |
| 4,728,493 | 3/1988 | Vreeland | 420/428 |
| 4,997,623 | 3/1991 | Brill | 420/442 |
| 5,021,215 | 6/1991 | Sawaragi et al. | 420/584.1 |
| 5,063,023 | 11/1991 | Sridhar | 420/442 |

FOREIGN PATENT DOCUMENTS

| | | | |
|---|---|---|---|
| 181431 | 3/1955 | Austria | 420/429 |
| 0425972 | 5/1991 | European Pat. Off. . | |

*Primary Examiner*—Richard O. Dean
*Assistant Examiner*—Sean Vincent
*Attorney, Agent, or Firm*—Gene E. Shook; Guy M. Miller; James A. Mackin

[57] ABSTRACT

$Cr_3Si$ is alloyed with molybdenum which produces a two-phase microstructure of $(Cr,Mo)_3Si$ and $(Cr,Mo)_5Si_3$. About 50 weight percent of molybdenum is present in the alloy. The alloy forms two protective oxides over a wide range of temperatures. Chromium and molybdenum oxide volatize under flowing air at high temperatures above 1200° C. which facilitates the formation of $SiO_2$ on the surface. Below 1200° C. $Cr_2O_3$ is formed. The new alloy has excellent high temperature strength and creep properties.

6 Claims, 5 Drawing Sheets

HIGH TEMPERATURE CREEP AND OXIDATION RESISTANT CHROMIUM SILICIDE MATRIX ALLOY CONTAINING MOLYBDENUM

ORIGIN OF THE INVENTION

The invention described herein was made by an employee of the U.S. Government and may be manufactured and used by or for the Government for governmental purposes without the payment of any royalties thereon or therefor.

TECHNICAL FIELD

This invention is directed to a new chromium silicide alloy composition. The invention is particularly concerned with alloying chromium silicide ($Cr_3Si$) with molybdenum to improve high temperature creep strength and oxidation resistance.

Superalloys are presently being used close to their maximum temperature capability of about 1050° C. in aircraft engine applications where they are limited by their creep strength and oxidation resistance. The intermetallic compound $Cr_3Si$ is being considered for these applications at similar or higher temperatures.

The chromium silicide intermetallic compound has a high melting point of about 1770° C., a cubic crystal structure which provides the compound isotropic properties, high elastic modulus of about 350 GPa at room temperature, and good high temperature strength of about 375 MPa at about 1250° C. The chromium silicide intermetallic compound further has a theoretical density of about 6.5 Mg $m^{-3}$ which is lower than the theoretical density of superalloys which is about 8.7 Mg $m^{-3}$. Also, unlike most other silicides which are line compounds, the single phase $Cr_3Si$ extends over 2 atomic percent variation in Si so that its mechanical and oxidation properties can be potentially improved by solid solution alloying.

Other silicides have been proposed for aircraft engine applications. For example, $MoSi_2$ is one such silicide which has been considered. While this intermetallic compound has excellent high temperature oxidation resistance, it has poor creep properties above 1000° C. and it disintegrates catastrophically by "pest" oxidation attack between 300° and 600° C.

A $Cr_3Si$ intermetallic alloy has poor oxidation resistance above 1150° C. Chromium oxidizes at a faster rate than silicon, and little or no protective layer of $SiO_2$ forms at the surface of the alloy at temperatures between 1200° C. and 1500° C.

It is, therefore, an object of the present invention to improve the creep and oxidation properties of $Cr_3Si$ by alloying with molybdenum.

Another object of the invention is to provide an improved alloy for use in aircraft engines and other high temperature environments having flowing combustion air where oxidation resistance and creep strength are important.

BACKGROUND ART

Henderson et al U.S. Pat. No. 4,696,703 relates to a corrosion resistance amorphous metal alloy containing chromium and molybdenum. Silicon is only a trace element, and it is not an intentional addition.

Vreeland U.S. Pat. No. 4,728,493 is concerned with a chromium nickel metallic alloy. The alloy is utilized to withstand seawater corrosion, and no reference is made to any high temperature oxidation resistance or the nature of the oxides formed. Silicon is added mainly to deoxidize the melt and promote fluidity during the casting of the alloy.

Brill et al U.S. Pat. No. 4,997,623 relates to a Ni-Cr-Fe austenitic metallic alloy containing several elements including 0.5% to 2.0% silicon and less than 0.1% molybdenum.

Sawaragi et al U.S. Pat. No. 5,021,215 describes a high temperature, high strength steel alloy. Sridhar U.S. Pat. No. 5,063,023 relates to a nickel base alloy for use in oxidizing aqueous acidic environments.

DISCLOSURE OF THE INVENTION

The problems of the prior art have been solved and the objects achieved by the present invention in which $Cr_3Si$ is alloyed with molybdenum which produces a two-phase microstructure of $(Cr,Mo)_3Si$ and $(Cr,Mo)_5Si_3$. The chromium and molybdenum oxides volatilize under flowing air at high temperatures typically at and above 1200° C. This facilitates the formation of an oxidation resistant $SiO_2$ layer at the surface. Below 1200° C. the oxidation resistance of the alloy is provided by the $Cr_2O_3$ so that the alloy is not subject to "pest" disintegration under isothermal conditions.

An important feature of the invention is that the alloy forms two protective oxides over a wide range of temperatures. More particularly $Cr_2O_3$ forms below 1200° C. and $SiO_2$ forms above this temperature. This is achieved by replacing chromium with sufficient amounts of molybdenum, by weight, to increase the volatility of chromium and molybdenum oxides.

BRIEF DESCRIPTION OF THE DRAWINGS

The objects advantages and novel features of the invention will be more fully apparent from the following detailed description when read in connection with the accompanying drawings wherein like numerals are used throughout to identify like parts.

BEST MODE FOR CARRYING OUT THE INVENTION

Figure 1:
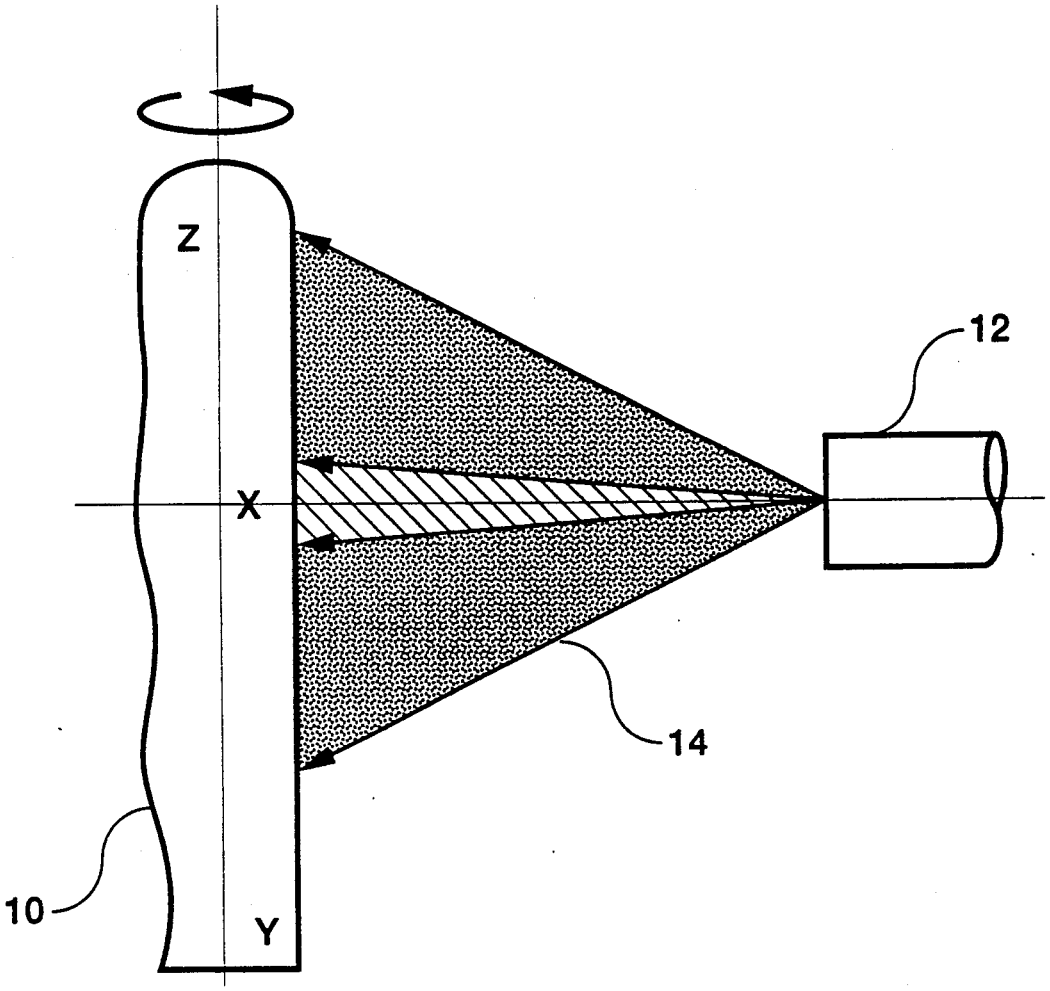
FIG. 1 is an elevation view of a burner nozzle and specimen used for burner rig testing.

Several $Cr_3Si$ alloys containing between 0 and about 55 weight percent molybdenum for replacing chromium were prepared by arc melting appropriate amounts of chromium, molybdenum, and silicon. The composition of these alloys in weight and atomic percents are set forth in Table I.

TABLE 1

| Alloy No. | Wt. % Cr | Wt. % Mo | Wt. % Si | At. % Cr | At. % Mo | At. % Si |
|---|---|---|---|---|---|---|
| 1 | 85.5 | 0.0 | 14.5 | 75.0 | 0.0 | 25.0 |
| 2 | 80.5 | 5.0 | 14.5 | 73.1 | 2.5 | 24.4 |
| 3 | 75.5 | 10.0 | 14.5 | 70.1 | 5.0 | 24.9 |
| 4 | 70.5 | 15.0 | 14.5 | 66.8 | 7.7 | 25.5 |
| 5 | 65.5 | 20.0 | 14.5 | 63.5 | 10.5 | 26.0 |
| 6 | 55.5 | 30.0 | 14.5 | 56.3 | 16.5 | 27.2 |
| 7 | 45.5 | 40.0 | 14.5 | 48.4 | 23.1 | 28.6 |
| 8 | 35.5 | 50.0 | 14.5 | 39.7 | 30.3 | 30.0 |

TABLE 1-continued

| Alloy No. | Wt. % Cr | Mo | Si | At. % Cr | Mo | Si |
|---|---|---|---|---|---|---|
| 9 | 29.53 | 54.51 | 15.96 | 33.3 | 33.3 | 33.3 |
| 10 | 19.98 | 36.89 | 43.13 | 16.7 | 16.7 | 16.7 |

A few specimens 10 about 125 mm to about 180 mm long and about 10.5 mm in diameter were prepared by induction melting the alloys under argon, and then casting them in a heated copper mold. These long specimens, as well as the shorter samples about 50 mm long which were prepared by arc-melting as explained above, were mounted in a burner rig of the type shown in FIG. 1 and tested without individual processing steps. In other cases, arc melted alloys containing about 50 weight percent molybdenum were crushed and sieved to −200 mesh powder. The powder was hot-pressed in a graphite die at about 1500° C. for about six hours under a pressure of about 30 MPa. The hot-pressed material was encapsulated in evacuated tantalum cans, which were sealed under vacuum, and then hot isostatically pressed at about 1500° C. for about two hours under an argon pressure of about 310 MPa. Compression and oxidation specimens were machined by electrodischarge machining.

The alloys were tested in a burner rig to duplicate the environment of an aircraft engine. A mixture of jet fuel and preheated air was maintained at a combustion pressure of about 0.007 MPa in the rig. Combustion gases exiting a combustor nozzle 12 in the form of a cone 14 were impinged on a single rotating specimen 10 at about 0.3 mach. These specimens were subjected to one-hour cycles between room temperature and about 1200° C. Each cycle was about 55 minutes long at the high temperature, followed by a five-minute quench to room temperature in forced air. The burner rig failure lives of several of the Cr—Mo—Si alloys at 1200° C. following one hour cycles are shown in Table 2.

TABLE 2

| Alloy No. | Cycle Life (h) | Remarks |
|---|---|---|
| 1 | <4 | Failed |
| 2 | 11 | Failed |
| 5 | <1 | Failed |
| 7 | <3 | Failed |
| 8 | 100 | Test stopped; Hot top |
| 9 | 81 | Failed; Hot top |
| 10 | 20 | Failed; Hot top |

All of the samples shown in Table 2 had preexisting cracks which resulted from the casting process. In addition, because of the inherent brittleness of the alloys, the hot tops were not cut off of any of the castings so that additional effects due to bending stresses may have been encountered. Therefore, the failure lives indicated in Table 2 are probably a lower boundary and represent a worst case scenario.

X-ray photoelectron spectroscopy (XPS) studies were conducted on alloy number 8 in the above Tables after a burner rig test showed that chromium and molybdenum were absent in the region X shown in FIG. 1 of the specimen 10 that is subjected to the direct impact by the combustion flame from the nozzle 12. Instead, this area X consisted primarily of $SiO_2$. However, oxides of chromium and molybdenum were observed in regions Y and Z which are away from the direct impact of the burner flame 14 shown in FIG. 1.

Based on this burner rig data, alloy number 8 was selected for more extensive tests to study its physical and mechanical properties. Microstructural observations revealed a two-phase microstructure comprising $(Cr,Mo)_3Si$ and $(Cr,Mo)_5Si_3$. This alloy had a density of about 7 grams per cubic centimeter and a melting point of about 1700° C. The addition of large amounts of molybdenum resulted in a somewhat denser alloy than $Cr_3Si$ which is about 6.5 $Mgm^{-3}$ and only about a 75° C. lowering of the melting point.

Low temperature oxidation studies conducted on the specimens with the pre-existing cracks between about 500° C. and about 1000° C. showed that the alloy is not susceptible to "pest" disintegration after maintaining at temperature for about 200 hours. That is, the samples did not disintegrate into powder although there was a small but measurable loss of weight. In contrast, $MoSi_2$ is known to be susceptible to "pesting" between 500° C. and 700° C. This limits its potential use as a structural material.

The alloy exhibits steady-state creep rate of about $10^{-10}$ to $1.5\times10^{-7}$ $S^{-1}$ at 1227° C. under stresses of about 50 to 100 MPa, respectively. Therefore, the creep strength of the alloy is comparable to or better than the creep properties of $MoSi_2$ reinforced with several volume percent SiC whiskers tested at about 1200° C.

Figure 2:
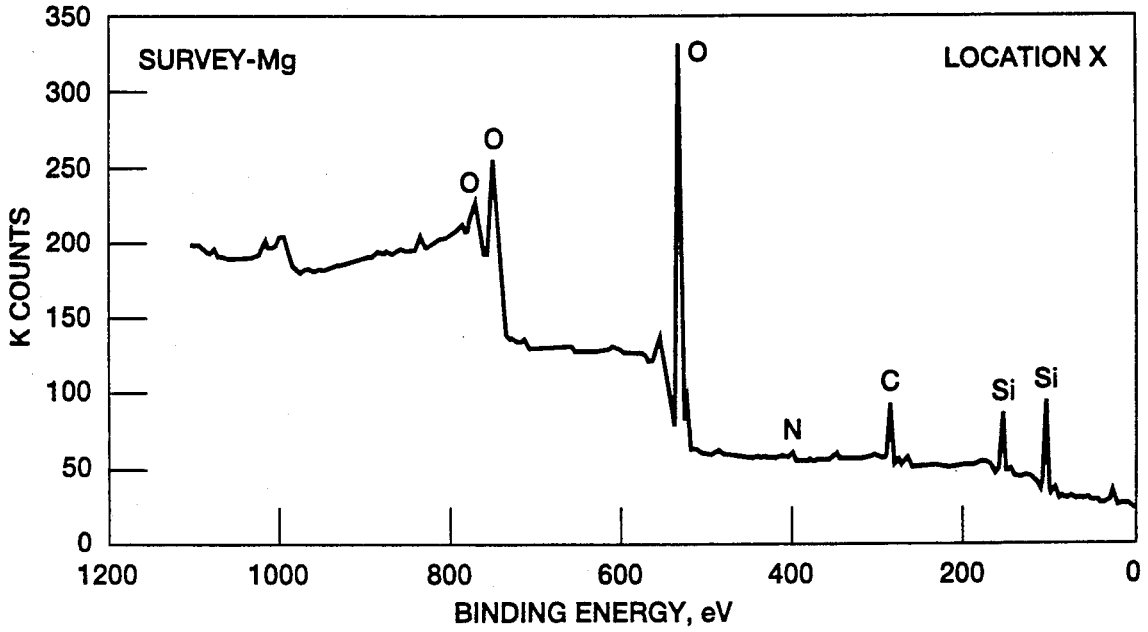
FIG. 2 shows X-RAY PHOTOELECTRON SPECTROSCOPY (XPS) data taken in region X in FIG. 1.
Figure 3:
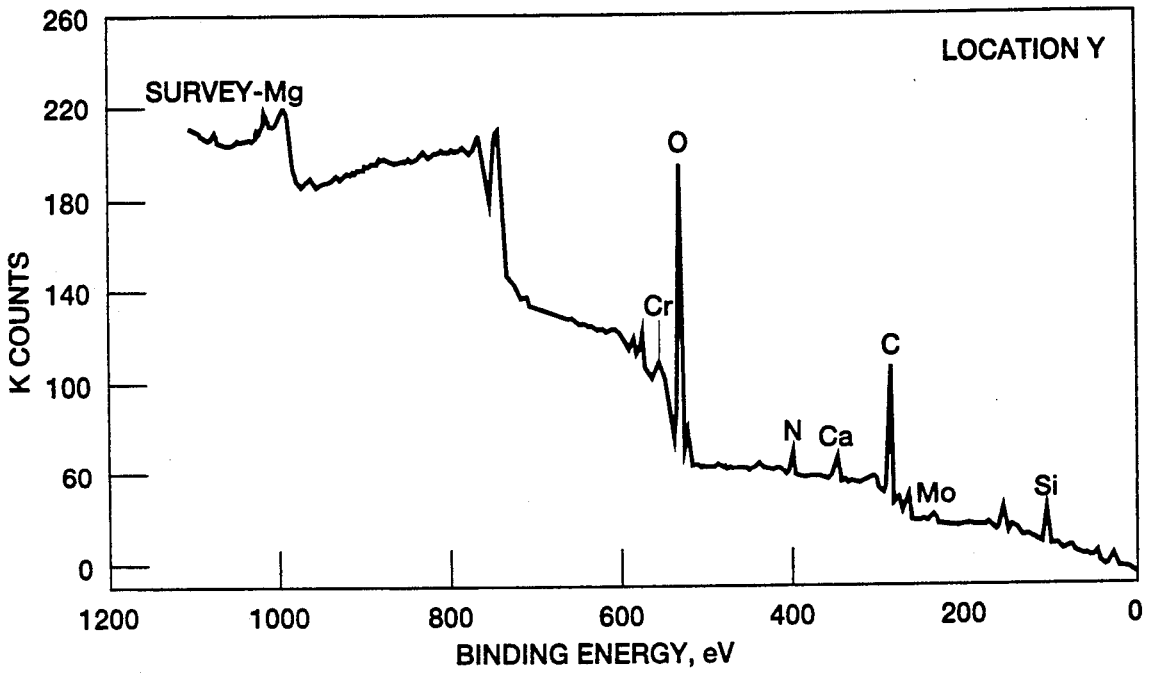
FIG. 3 shows XPS data taken in region Y in FIG. 1.
Figure 4:
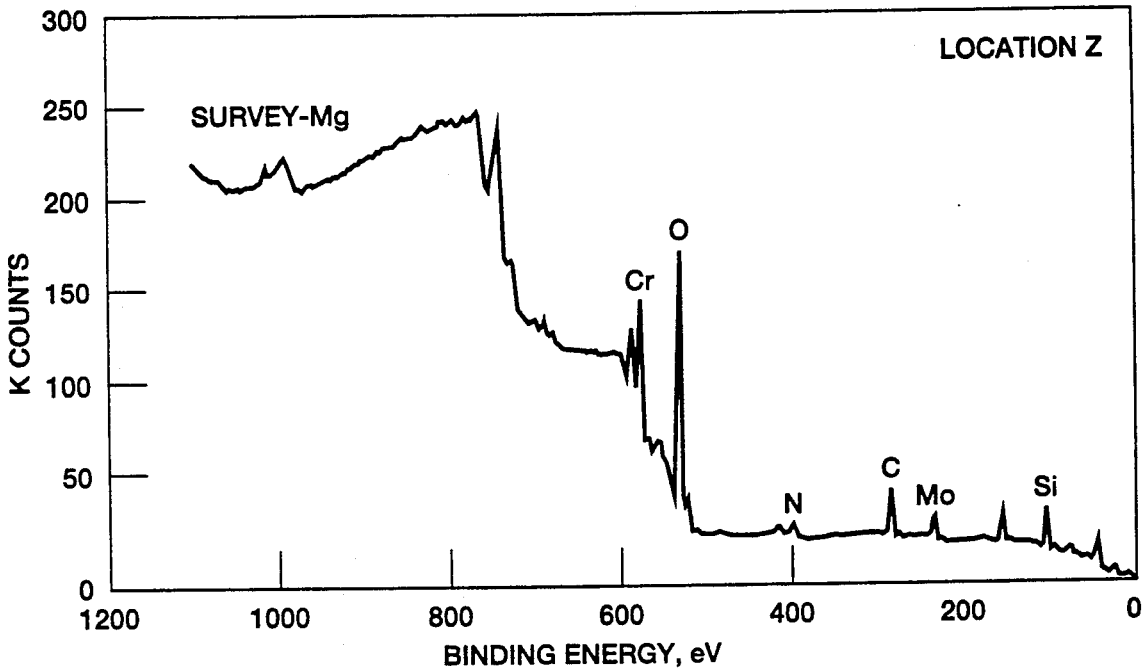
FIG. 4 shows XPS data taken in region Z in FIG. 1.

Referring again to FIG. 1 there is shown a selectively rotatable specimen 10_mounted between about 2 inches and 2.5 inches away from a combustor nozzle 12. X-Ray photoelectron spectroscopy (XPS) data for regions X, Y and Z are shown in FIGS. 2,3 and 4.

The region of the specimen 10 that is directly in front of the nozzle 12 is identified as X in FIG. 1. The XPS data taken in this region are shown in FIG. 2. The composition of the specimen 10 in this region, in atomic percent, is about 20 at. % carbon, 49 at. % oxygen, and 31 at. % silicon after exposure in the burner rig. Oxides of silicon identified were $SiO_2$ and Si oxy-carbide. Here again it was demonstrated that chromium and molybdenum were absent in the region X of FIG. 1 of the specimen 10 that is subjected to the direct impact by the combustion flame from the nozzle 14. This area consisted primarily of $SiO_2$.

The region of the specimen 10 that is at the edge of the cone 14 is identified as Y in FIG. 1. The XPS data taken at this location are shown in FIG. 3. The composition of the specimen 10 in region Y, in atomic percents, is about 47 at. % carbon, 1.5 at. % chromium, 0.5 at. % molybdenum, 38 at. % oxygen, and 12.9 at. % silicon. Oxides identified were MoO, Cr suboxide, Si oxy-carbide, and Si oxy-nitride.

The region of the specimen 10 that is outside the cone 14 is identified as Z in FIG. 1. The XPS data taken in this region are shown in FIG. 4. The composition of the specimen 10 in region Z, in atomic percents, is about 24 at. % carbon, 8 at. % chromium, 1 at. % molybdenum, 49 at. % oxygen, and 18.0 at. % silicon. As observed previously, both chromium and molybdenum are present in the regions Y and Z which are away from the direct impact of the flame from the nozzle 12.

Figure 5:
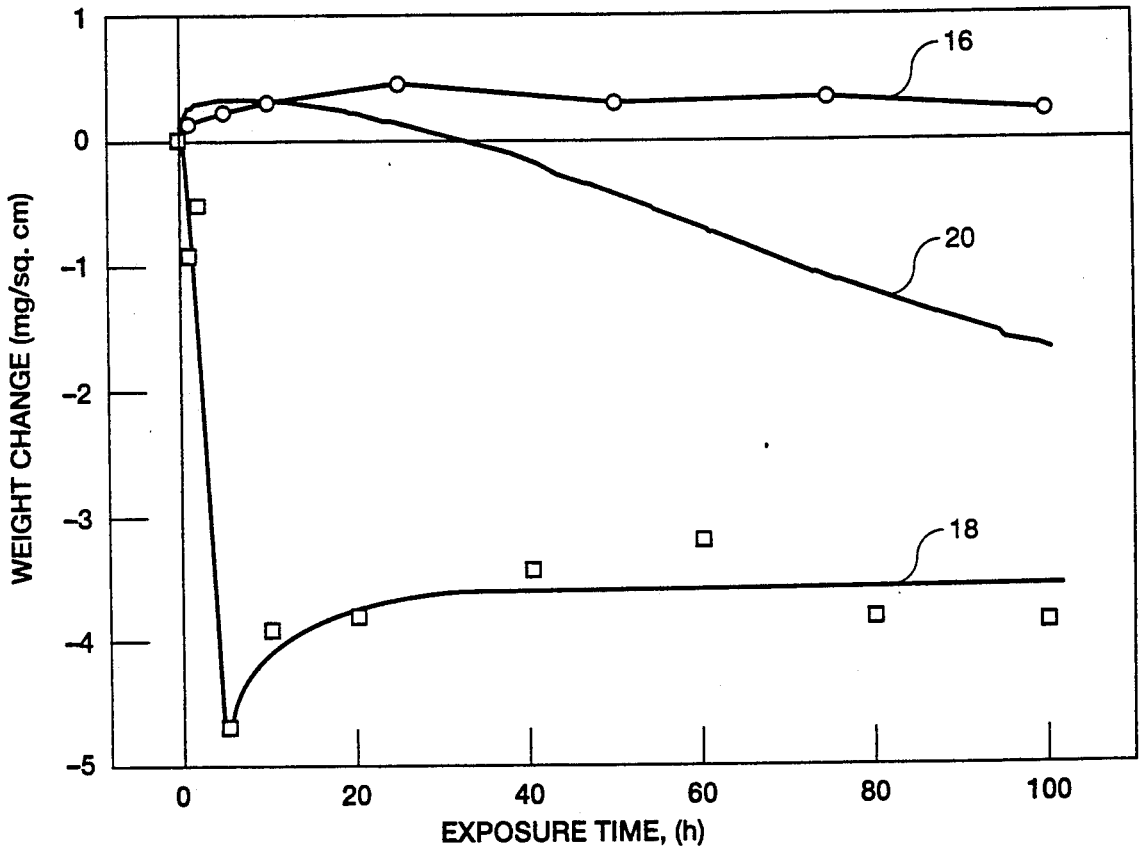
FIG. 5 is a graph showing weight change per unit area plotted against exposure time for a specimen at 1200° C.

Referring to FIG. 5 there is shown a graph of specific weight change against exposure time at 1200° C. for an alloy of 39.7 at. % chromium, 30.3 at. % molybdenum, and 30.0 at. % silicon, i.e. alloy number 8 in Table 1. The cyclic change of the specimen is shown by a line 16. The weight change of a specimen 10 facing a combustor nozzle 12 in a burner rig is shown by the line 18. Isothermal weight loss is shown by a line 20.

DESCRIPTION OF ALTERNATE EMBODIMENTS

It is contemplated that the intermetallic alloy of the present invention may be toughened and strengthened with particulates and fibers, such as $TiB_2$, HfC, $Si_3N_4$, $ZrO_2$ and SiC. It is further contemplated that alternate processing techniques may be used to obtain directionally solidified eutectic microstructures using the $Mo_5Si_3$ second phase to both strengthen and brittle phase toughen the alloy. The alloy also has the potential to be formed into near net-shape using conventional hot deformation techniques, such as rolling, forging and extrusion. The addition of other alloying elements, such as boron, carbon, zirconium, and rare earth elements may be relied on to improve the oxidation and mechanical properties of the alloy.

Numerous modifications and adaptations of the present invention will be apparent to those so skilled in the art and thus it is intended by the following claims to cover all modifications and adaptations which fall within processing the true spirit and scope of the invention.

What is claimed:

1. A $Cr_3Si$ matrix alloy having improved high temperature creep strength and oxidation resistance at temperatures up to about 1400° C. comprising about 20 wt % to about 80 wt % chromium, about 50 wt % molybdenum, and about 14.5 wt % to about 43 wt % silicon so that a two-phase microstructure of $(Cr,Mo)_3Si$ and $(Cr,Mo)_5Si_3$ is produced.

2. An alloy as claimed in claim 1 wherein the alloy contains between about 30 wt % to about 60 wt % chromium and about 14.5 wt % to about 20 wt % silicon.

3. An alloy as claimed in claim 1 wherein the alloy contains about 35.5 wt % chromium and about 14.5 wt % silicon.

4. A method of improving the high temperature creep strength and oxidation resistance of a $Cr_3Si$ alloy comprising alloying about 50 wt % molybdenum with said alloy to produce a two-phase microstructure of $(Cr,Mo)_3Si$ and $(Cr,Mo)_5Si_3$ so that $Cr_2O_3$ is formed below about 1200° C. and $SiO_3$ is formed above about 1200° C.

5. A method of improving the high temperature creep strength and oxidation resistance of a $Cr_3Si$ alloy as claimed in claim 4 wherein said alloy contains between about 30 wt % to about 60 wt % chromium and about 14.5 wt % to about 20 wt % silicon.

6. A method as claimed in claim 4 wherein the alloy contains about 35.5 wt % chromium and about 14.5 wt % silicon.

* * * * *